US007891398B2

(12) United States Patent
Chino et al.

(10) Patent No.: US 7,891,398 B2
(45) Date of Patent: Feb. 22, 2011

(54) SCREEN DEVICE

(75) Inventors: Mitsuhiko Chino, Nerima-ku (JP); Masato Moriya, Nerima-ku (JP); Tetsuya Iida, Nerima-ku (JP)

(73) Assignee: Seiki Hanbai Co., Ltd., Tokyo (JP)

( * ) Notice: Subject to any disclaimer, the term of this patent is extended or adjusted under 35 U.S.C. 154(b) by 563 days.

(21) Appl. No.: 11/813,044

(22) PCT Filed: Dec. 27, 2005

(86) PCT No.: PCT/JP2005/023889

§ 371 (c)(1),
(2), (4) Date: Jun. 28, 2007

(87) PCT Pub. No.: WO2006/070796

PCT Pub. Date: Jul. 6, 2006

(65) Prior Publication Data

US 2008/0115897 A1 May 22, 2008

(30) Foreign Application Priority Data

Dec. 28, 2004 (JP) ..... 2004-380739

(51) Int. Cl.
*E06B 3/94* (2006.01)

(52) U.S. Cl. ..... 160/84.06; 160/84.04

(58) Field of Classification Search ..... 160/84.06, 160/84.04, 84.05, 35, 34, 33, 172 R, 172 V
See application file for complete search history.

(56) References Cited

U.S. PATENT DOCUMENTS 2,181,897 A * 12/1939 Kapp ..... 160/172 R
2,328,305 A * 8/1943 De Stefano ..... 160/170
3,129,750 A * 4/1964 Brandin ..... 160/168.1 R
4,202,395 A * 5/1980 Heck et al. ..... 160/84.06
4,212,341 A * 7/1980 Fisher ..... 160/84.04
4,473,101 A * 9/1984 Langeler ..... 160/84.06
4,557,309 A * 12/1985 Judkins ..... 160/84.06
4,673,018 A * 6/1987 Judkins ..... 160/84.06
4,687,038 A * 8/1987 Clemente ..... 160/84.06

(Continued)

FOREIGN PATENT DOCUMENTS

JP 7 317466 12/1995

(Continued)

*Primary Examiner*—Katherine Mitchell
*Assistant Examiner*—Jamie F Cardenas-Garcia
(74) *Attorney, Agent, or Firm*—Oblon, Spivak, McClelland, Maier & Neustadt, L.L.P.

(57) ABSTRACT

A screen device includes an expandable and contractible folding screen connected to a side frame member and to a movable stile to be opened and closed, and a translation mechanism for the movable stile. The translation mechanism includes a single wire having three or more segments arranged in rows extending through the screen. The wire segments are redirected at an inlet to the movable stile, are guided along the length of the movable stile, are redirected in upper and lower areas of the movable stile, and are guided along the lateral frame members toward the opposite frame member, thereby the wire stretches between the movable stile and the opposite frame member the same number of times as the number of wire segments extending through the screen to absorb changes in the length of the wire segments extending through the screen in accordance with movement of the movable stile.

15 Claims, 12 Drawing Sheets

U.S. PATENT DOCUMENTS

| | | | | | |
|---|---|---|---|---|---|
| 4,733,711 | A * | 3/1988 | Schon | 160/84.03 |
| 4,753,281 | A * | 6/1988 | Wagner | 160/84.06 |
| 4,762,159 | A * | 8/1988 | Ford | 160/84.06 |
| 4,825,929 | A * | 5/1989 | Haines | 160/84.06 |
| 4,852,627 | A * | 8/1989 | Peterson et al. | 160/84.02 |
| 4,919,186 | A * | 4/1990 | Uecker et al. | 160/321 |
| 5,092,383 | A * | 3/1992 | Niemeijer et al. | 160/84.07 |
| 5,274,357 | A * | 12/1993 | Riordan | 340/550 |
| 5,351,737 | A * | 10/1994 | Hoshiyama | 160/84.03 |
| 5,533,559 | A * | 7/1996 | Judkins | 160/84.06 |
| 5,860,464 | A * | 1/1999 | Schon | 160/84.06 |
| 6,047,760 | A * | 4/2000 | Judkins | 160/168.1 R |
| 6,691,760 | B1 * | 2/2004 | Randall et al. | 160/84.04 |
| 6,796,360 | B2 * | 9/2004 | Ferrie et al. | 160/172 R |
| 7,096,917 | B2 * | 8/2006 | Ciuca et al. | 160/170 |
| 7,261,137 | B2 * | 8/2007 | Dekker | 160/84.04 |
| 2004/0016513 | A1 * | 1/2004 | Hung | 160/84.06 |
| 2005/0150607 | A1 * | 7/2005 | Dekker | 160/84.04 |

FOREIGN PATENT DOCUMENTS

| | | |
|---|---|---|
| JP | 8 93361 | 4/1996 |
| JP | 8 199948 | 8/1996 |
| JP | 9 105284 | 4/1997 |
| JP | 9 328977 | 12/1997 |
| JP | 2000 337054 | 12/2000 |

* cited by examiner

SCREEN DEVICE

TECHNICAL FIELD

The present invention generally relates to a screen device to be mounted on an opening of a building for such purposes as insect prevention, light shielding, and heat insulation, and in particular to a mechanism for use in the screen device in which a screen held at one end thereof by a screen frame can be opened and closed with a movable stile that can be translated by means of a wire or wires extending through the screen, the mechanism relying on a single wire arranged in multiple rows extending through the screen to enable translational movement of the movable stile.

BACKGROUND ART

Patent Document 1 discloses a screen device with an expandable and contractible folding screen that can be opened and closed with a movable stile that is moved by a translation mechanism including two wires. One end of each of the wires is fastened to one of upper and lower areas of one of the side frame members of the screen frame to which one end of the screen is fastened. The wires extend through the screen along its expansion/contraction direction, one wire is then guided upward and the other wire is guided downward within the movable stile, the wires are respectively redirected at upper and lower ends of the movable stile, are guided along upper and lower lateral frames to upper and lower ends of a receiving frame member facing the movable stile, and fastened at the other end thereto.

Another known type of translation mechanism relies on a single wire instead of two.

In this type of screen device with an expandable and contractible folding screen, a wire should extend through an intermediate section as well as through the upper and lower sections of the screen to keep the screen in a stably stretched state without bulging or the like. In the screen device disclosed by Patent Document 1, an intermediate wire can also be extended between the upper and lower wires.

When the intermediate wire is provided, means for absorbing the change in length of the intermediate wire is also required, because the length of each wire extending through the screen varies when the screen width changes in accordance with the movement of the movable stile. In such a case, a plurality of wires should be provided as shown in FIGS. 4 to 6 of Patent Document 1, and the individual wires should be adjusted in length relative to each other. This would lead to a complicated structure that supposes time-consuming assembly, difficult installation adjustment, and troublesome maintenance in case the screen is damaged or the wires should require replacement.

Patent Document 1: Japanese unexamined patent application publication No. JP-A-H05-179875

DISCLOSURE OF INVENTION

Problems to be Solved by the Invention

A technical problem of the present invention is to provide a screen device having a translation mechanism that is simpler in structure and at the same time assures easier assembly and installation adjustment than that used in the above screen device in which any number of intermediate wires may be extended.

Another technical problem of the present invention is to provide a screen device having a translation mechanism with the wire extending only through the screen and the fixing plates fastened thereto, without extending through the screen frame members, thereby facilitating the replacement of the screen.

Means of Solving the Problems

To solve the above problems, the present invention is characterized in that, in a screen device including a screen frame to be mounted on an opening of a building, an expandable and contractible folding screen connected at one end thereof to a side frame member of the screen frame and at the other end thereof to a movable stile that is guided along the screen frame so as to be capable of being opened and closed, and a translation mechanism for enabling translational movement of the movable stile, the translation mechanism relies on a single wire including three or more segments that are arranged in rows extending through the screen in its expansion/contraction direction. The wire segments are then redirected upward or downward at an inlet to the movable stile, and guided along the length of the movable stile, among which at least one wire segment selected out of those guided upward and at least one wire segment selected out of those guided downward are redirected in upper and lower areas, respectively, of the movable stile, and guided along either lateral frame member of the screen frame toward an opposite frame member facing the movable stile, so that the wire segments along the lateral frame members constitute an adjustment means that can absorb changes in length of the wire segments extending through the screen in accordance with the movement of the movable stile. Both ends of the wire are connected to the side frame member, the opposite frame member, either lateral frame member near the side or opposite frame member, or to the movable stile. The attitude of the movable stile is kept constrained by the wire at any position to which the movable stile is moved.

In a screen device in a preferred embodiment of the present invention, the wire is connected only at both ends thereof to the side frame member, the opposite frame member, either lateral frame member near the side or opposite frame member, or to the movable stile. Alternatively, the wire may be connected at both ends thereof and at an intermediate point or points that are not displaced relative to the side frame member or movable stile in its longitudinal direction, to the side frame member or movable stile.

In the screen device in another preferred embodiment of the present invention, the adjustment means may be configured in such a manner that the wire segments that are arranged in rows extending through the screen, then redirected at an inlet to the movable stile, and guided along the length of the movable stile are all redirected in the upper and lower areas of the movable stile and guided along the lateral frames of the screen frame toward the opposite frame member facing the movable stile, so the wire is stretched between the movable stile and the opposite frame member the same number of times as the number of wire segments arranged in rows between the side frame member and the movable stile. The wire segments that are not fastened to the opposite frame member are turned back.

In this configuration, the wire segments not fastened on the opposite frame member side are wound around a deflector that is pivotally supported on the opposite frame member or lateral frame member with its axis held in the direction in which the wire is turned back, so the wire segment twisted by its reciprocating motion becomes untwisted.

In the screen device in another preferred embodiment of the present invention, the adjustment means is configured so that some of the wire segments that are arranged in rows extending through the screen, then redirected at the inlet to the movable stile, and guided along the length of the movable stile are redirected in the upper and lower areas of the movable stile and guided along the lateral frame members toward the opposite frame member facing the movable stile, while the remaining wire segments are connected to the above wire segments so that the wire segments along the lateral frame members can absorb changes in length of the wire segments extending through the screen in accordance with the movement of the movable stile.

In the screen device in another preferred embodiment of the present invention, one end of the screen is detachably fastened to the side frame member of the screen frame with a fixing plate attached to that end of the screen therebetween. The screen and the movable stile are detachably guided along the lateral frame members of the screen frame. The wire segments extending through the screen are fastened to or turned back through the fixing plate, without extending through the side frame member. Both ends of the wire are detachably connected. The wire segments that are not fastened to the opposite frame member side are wound around a deflector that is detachably mounted thereon. In this configuration, the screen can be demounted together with the movable stile from the screen frame. If the other end of the screen is detachably fastened to the movable stile with a fixing plate attached to that end of the screen therebetween and the wire segments extending through the screen between the side frame member and the movable stile are fastened to or turned back through the fixing plates without extending through the side frame member and the movable stile, it is possible to demount only the screen from the screen frame.

Effect of the Invention

In the screen device of the present invention described above, the translation mechanism for the movable stile relies on a single wire extending through the screen, so the translation mechanism can be configured simply by extending the wire through the screen and fastening both ends of the wire. This simplifies the assembly and installation adjustment of the screen device. The wire of the translation mechanism extends only through the screen and the fixing plates attached thereto, without extending through the screen frame members, so the screen can be replaced simply by demounting the screen, together with the wire, from the screen frame.

REFERENCE NUMERALS

Figure 1:
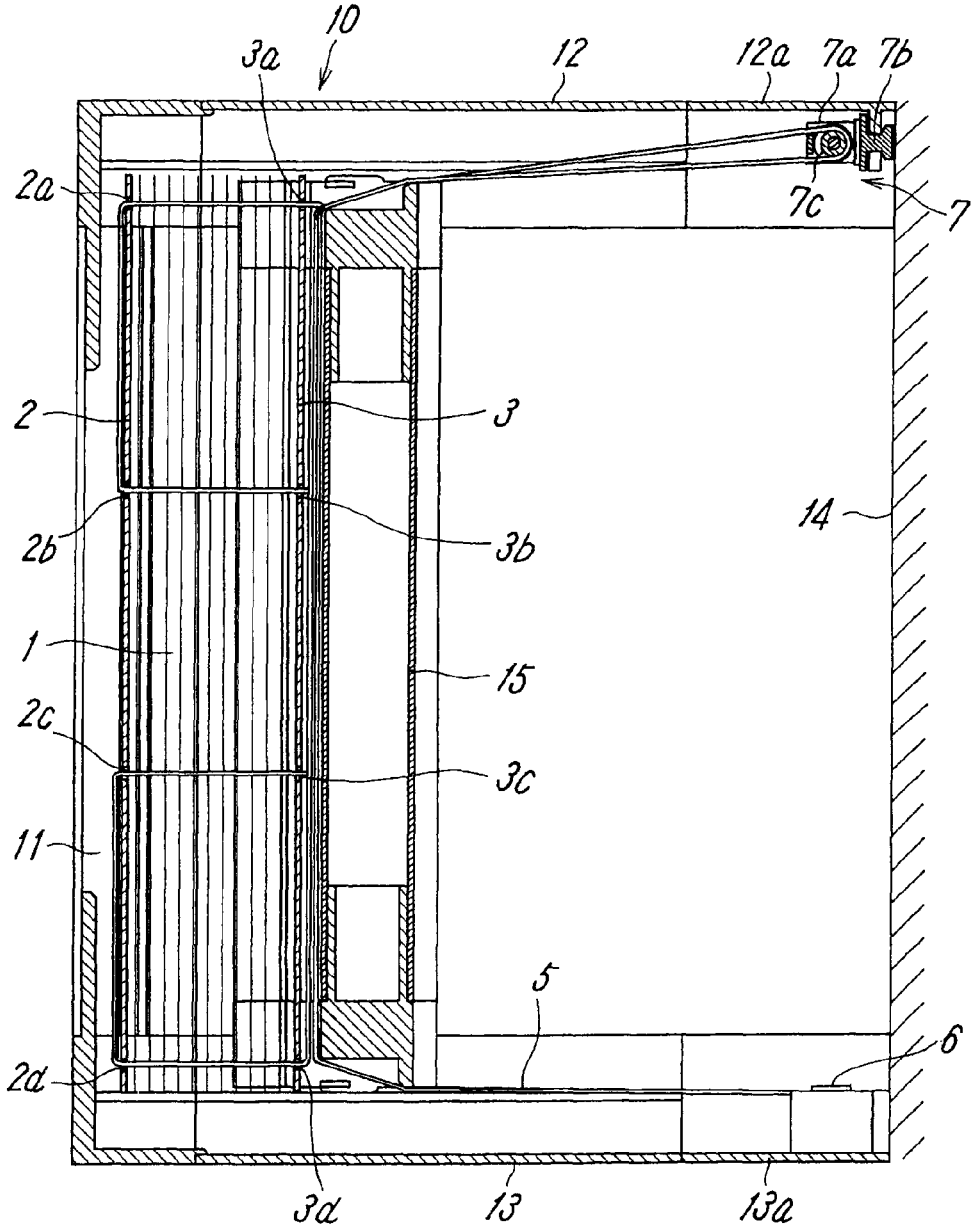
FIG. 1 is a front longitudinal sectional view of a screen device in a first embodiment of the present invention.

1 Screen
2, 3 Fixing plates
5 Wire
7 Deflector
10 Screen frame
11 Side frame member
12, 13 Lateral frame members
12*a*, 13*a* Connected pieces
14 opposite frame member
15 Movable stile

BEST MODE FOR CARRYING OUT THE INVENTION

FIGS. 1 to 4 show a screen device in an embodiment of the present invention. This screen device is mainly intended to be mounted on a window, doorway, or other opening of a building for such purposes as insect prevention, light shielding, and heat insulation. A screen 1 for a particular purpose is openably and closably stretched in a screen frame 10 that is fixedly mounted on the opening of the building with screws or other fastening means. The screen frame 10 need not necessarily be fastened to all four sides of the opening of the building. In this embodiment, the screen frame 10 is composed of a side frame member 11 to which one end of the screen 1 is connected, and upper and lower lateral frame members 12, 13 that guide the upper and lower ends of a movable stile 15. The screen frame 10 does not have a receiving frame member facing the movable stile 15 and instead makes use of a frame member of the opening of the building as a part of the screen frame 10. Alternatively, a receiving frame member that faces the movable stile 15 and abuts against the movable stile 15 when the screen 1 is fully stretched may be fixedly provided in the frame of the opening of the building. These frame members facing the movable stile will collectively be referred to hereinafter as an opposite frame member 14.

The screen 1 is formed of a foldable mosquito net for example. With multiple parallel pleats provided, the screen 1 is accordion-foldable so as to be expandable and contractible. To detachably fasten both ends of the screen to the movable stile 15 and the side frame member 11 of the screen frame 10 respectively, plastic fixing plates 2, 3 are fixedly attached to both ends of the screen 1 with adhesive tape. The means for attaching the fixing plates 2, 3 is not limited to adhesive tape and any other means may be used. To detachably fasten the fixing plates 2, 3, the fixing plate 2 is fit into a narrow slit-like mounting groove 11*a* provided in the side frame member 11 of the screen frame 10 and the fixing plate 3 is fit into a narrow slit-like mounting groove 15*a* provided in the movable stile 15. The fixing plates 2, 3 may have some flexibility so as to be press fit into the narrow slit-like mounting grooves 11*a*, 15*a*, respectively, or simple spring fasteners, screws, or the like may be used instead to detachably fasten the fixing plates 2, 3.

The movable stile 15, to which the fixing plate 3 on one end of the screen 1 is connected, has upper and lower ends that are slidably guided along the upper and lower lateral frame members 12, 13 of the screen frame 10. Desirably, the upper and lower ends of the movable stile 15 can easily be detached from the screen frame when a wire 5 of the translation mechanism for the movable stile is partially disconnected and the movable stile 15 is tilted for example in the screen stretching plane. If the wire 5 can easily be disconnected from the movable stile 15 mounted on the screen frame 10, the movable stile 15 need not necessarily be easily demountable from the screen frame 10.

For translational movement of the movable stile 15, this screen device is provided with a translation mechanism that continuously maintains the attitude of the movable stile 15 so as to stabilize the translational movement of the movable stile 15. This translation mechanism includes a single wire 5 arranged in the screen frame in three or more rows extending through the screen 1 in its expansion/contraction direction and serves to prevent the screen 1 from slacking or being swayed by wind for example.

Figure 4:
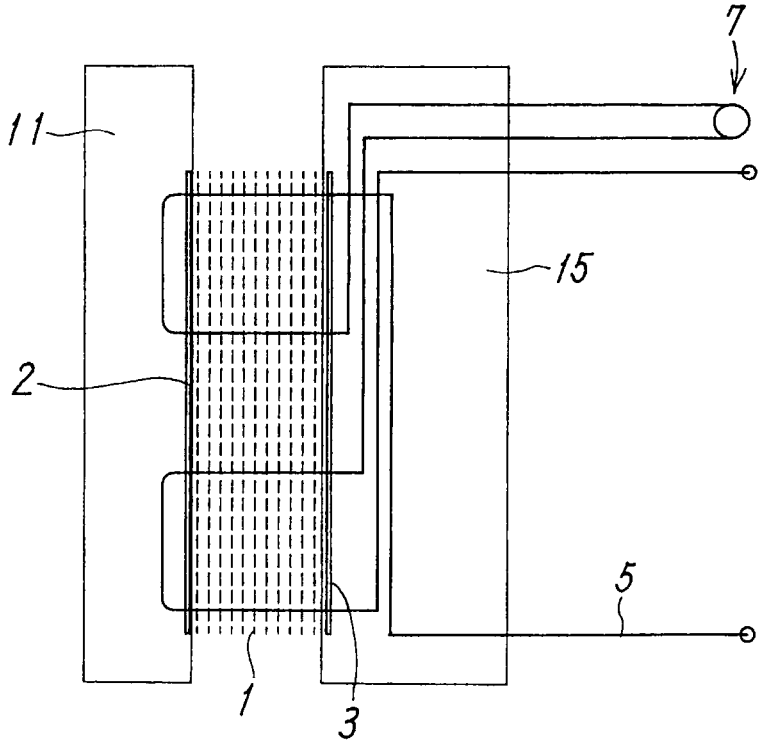
FIG. 4 schematically illustrates a wire arrangement of a translation mechanism in the first embodiment of the present invention.

More specifically, in this embodiment, as can be seen from the schematic drawings in FIGS. 1 and 4, the wire 5 is arranged in four rows extending through the screen 1 and has one end thereof detachably fastened to the lower lateral frame member 13 near the opposite frame member 14. Although the wire 5 is detachably fastened at one end thereof to the lateral frame member 13 with a screw 6 in the configuration shown in FIG. 3, the wire 5 may be fixedly or detachably connected at one end thereof to a detachably connected piece 13*a* forming a part of the lower lateral frame member 13 as in this embodiment and the embodiment shown in FIG. 7. The connected piece 13*a* is fit into the lateral frame member 13 or fastened directly to the frame member of the opening of the building with a screw or other fastening means, so that the connected piece 13*a* is detachable from the main body of the lateral frame member 13 that is fixedly held in position. Alternatively, the wire 5 can detachably be connected at one end thereof to the opposite frame member 14 with a screw or other fastening means.

The wire 5 having one end thereof fastened to the lateral frame member 13 or to the connected piece 13*a* is guided to the lower area of the movable stile 15, then guided upward along the fixing plate 3 fastened to the movable stile 15, without being introduced into the movable stile 15 itself, then passes through a guide hole 3*a* provided in the fixing plate 3 near the upper end of the screen 1, extends through the screen 1, and is drawn out of the screen through a guide hole 2*a* in the fixing plate 2 fastened to the side frame member 11. The wire 5 drawn out to the rear of the fixing plate 2 is introduced through a guide hole 2*b* in the fixing plate 2 to an intermediate section of the screen 1, extends toward the movable stile 15, then guided through a guide hole 3*b* in the fixing plate 3 fastened to the movable stile 15, redirected upward along the length of the movable stile 15, without being introduced into the movable stile 15 itself, and is guided above the upper end of the movable stile 15 toward the opposite frame member 14.

Figure 2:
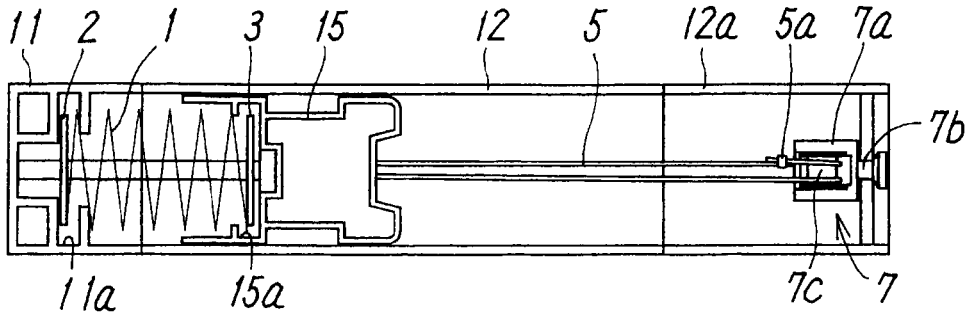
FIG. 2 is a horizontal sectional view showing the structure of an upper lateral frame member in the first embodiment of the present invention.
Figure 3:
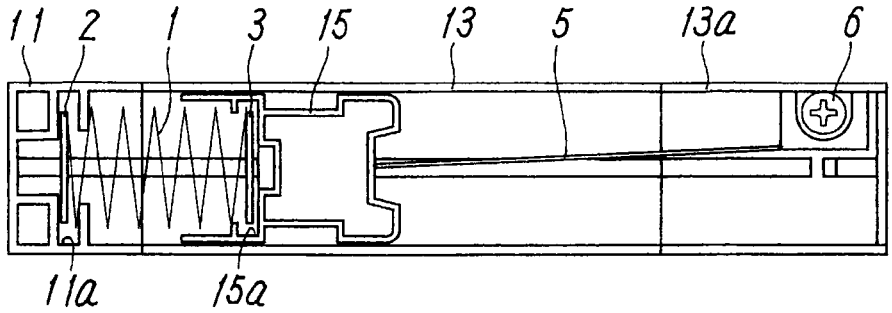
FIG. 3 is a horizontal sectional view showing the structure of a lower lateral frame member in the first embodiment of the present invention.
Figure 7:
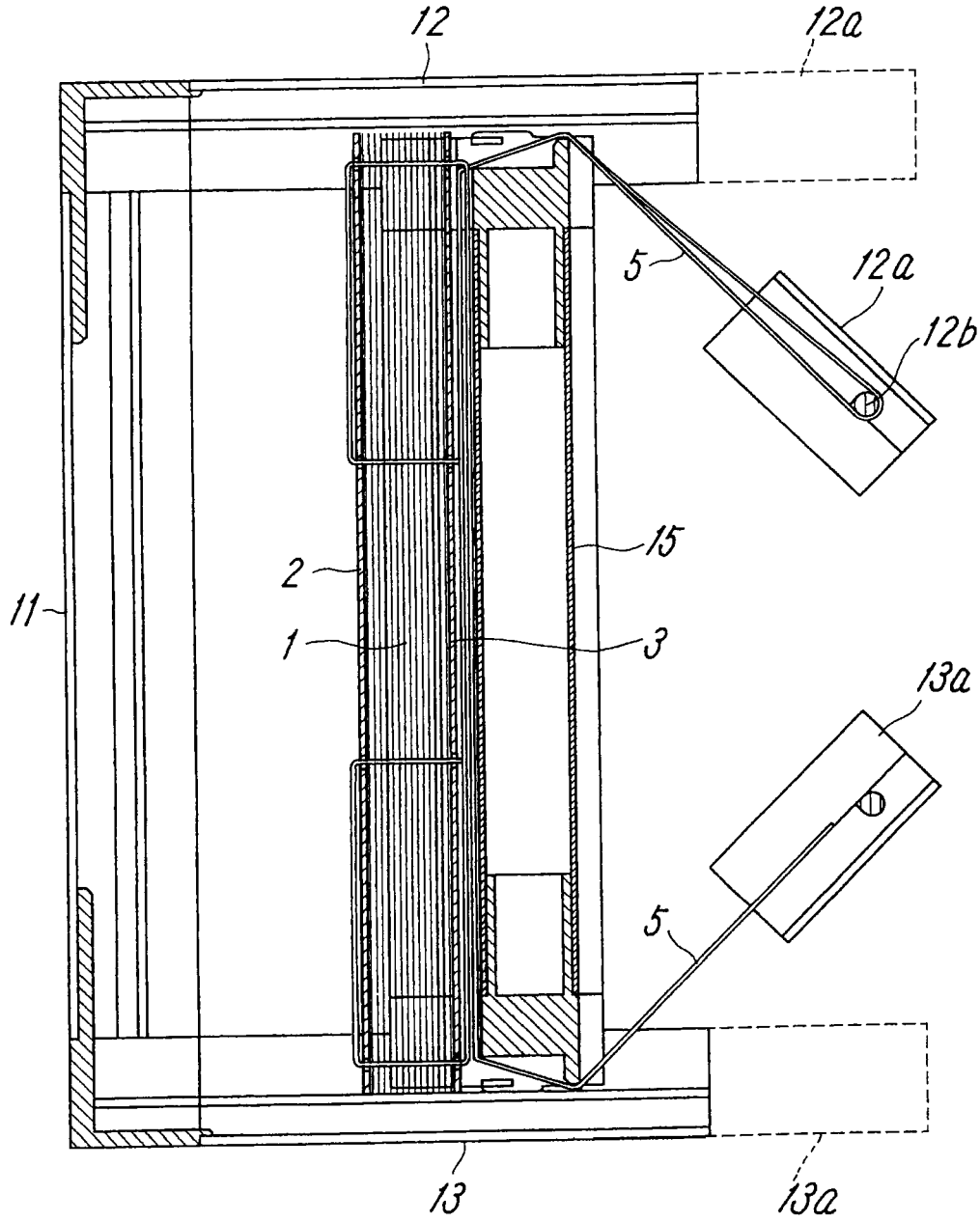
FIG. 7 is a front longitudinal sectional view showing how to mount and demount the screen in a screen device in another embodiment of the present invention.

A deflector 7 is provided on the lateral frame member 12 itself near the upper end of the opposite frame member 14, or on the connected piece 12*a* detachable from the lateral frame member 12 to turn back the wire 5 without fastening it thereto. The deflector 7 around which the wire 5 is wound includes a deflector body 7*a*, a pivot member 7*b*, and a roller 7*c*. The axis of the pivot member 7*b* is held in the direction in which the wire 5 extends. The wire 5 is wound around the roller 7*c*. The pivot member 7*b* is rotatably supported in a downward projection of the upper lateral frame member 12. The deflector 7 may be provided on the opposite frame member 14 with its pivot member 7*b* rotatably supported. The pivotal motion of the deflector 7 effectively serves to automatically untwist the wire 5 that is twisted by its reciprocation around the deflector 7. Alternatively, a support shaft 12*b* for turning back the wire 5 may be provided on the detachably connected piece 12*a* forming a part of the upper lateral frame member 12 as shown in FIG. 7, or the deflector 7 as shown in FIGS. 1 and 2 may be connected to the connected piece 12*a* in a rotatable and detachable manner. The connected piece 12*a*, similar to the connected piece 13*a*, is fit into or otherwise connected to the lateral frame member 12 itself, or detachably fastened to the frame member of the opening of the building with a screw or the like, so that the connected piece 12*a* is detachable from the main body of the lateral frame member 12.

The wire 5 that is turned back by the deflector 7 returns toward the upper end of the movable stile 15, passes above the upper end of the movable stile 15, is redirected downward, guided along the fixing plate 3, without being introduced into the movable stile 15, and is introduced through a guide hole 3*c* located below the guide hole 3*b* to another intermediate section of the screen. Then, the wire 5 passes through a guide hole 2*c* in the fixing plate 2 fastened to the side frame member 11 to the rear of the fixing plate 2. The wire 5 is then introduced through a guide hole 2*d* in the fixing plate 2 to a lower section of the screen 1, extends toward the movable stile 15, passes through a guide hole 3*d* in the fixing plate 3 fastened to the movable stile 15, and is redirected upward along the length of the movable stile 15. Then, the wire 5 passes above the upper end of the movable stile 15, is redirected toward the opposite frame member 14 without being introduced into the movable stile 15 itself, and is connected at its leading end to the roller 7*c* of the deflector 7 with a fastener 5*a* (see FIG. 2). The leading end of the wire 5 may be fastened in a detachable manner to the upper lateral frame member 12 near the opposite frame member 14 with a screw or the like in a mounting structure similar to that for its starting end.

Desirably, the guide holes 2*a* to 2*d* and 3*a* to 3*d* provided in the fixing plates 2, 3 are small holes each provided with a plastic eyelet having a low friction with respect to the wire 5, although the guide holes 2*a* to 2*d* and 3*a* to 3*d* are not limited to this structure and may be formed in the fixing plates 2, 3 made of a synthetic resin.

Figure 5:
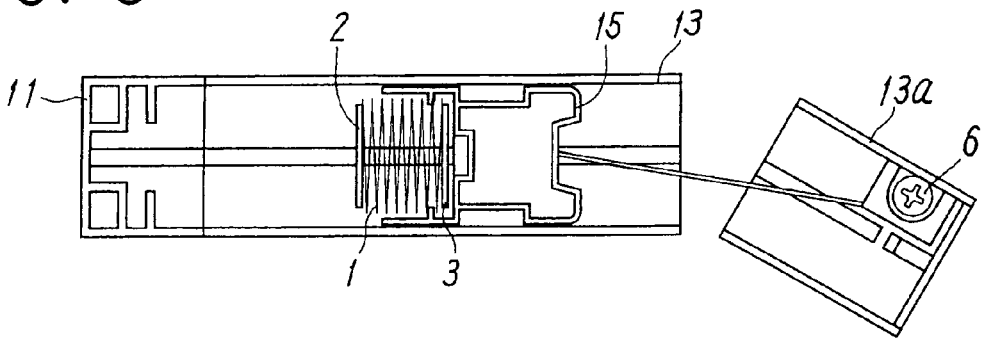
FIG. 5 is a horizontal front view illustrating how to mount and demount the screen in the first embodiment of the present invention.
Figure 6:
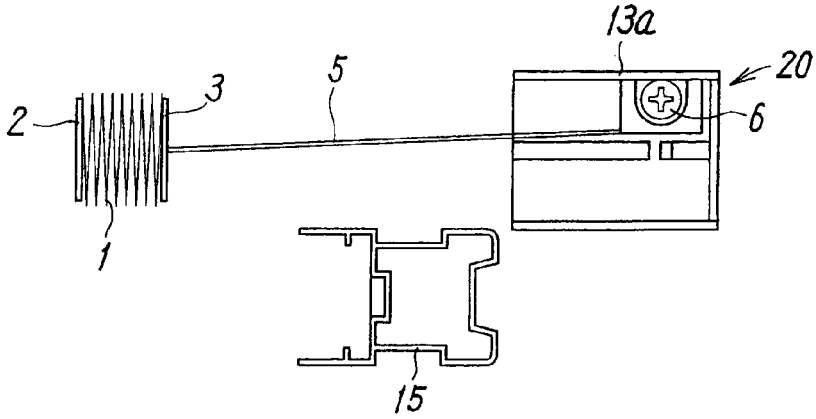
FIG. 6 is a plan view showing the demounted screen.

In the screen device having the above structure, the screen 1 to be replaced is demounted from the screen frame 10 as follows. First, both ends of the wire 5 are disconnected, together with the connected pieces 12*a*, 13*a*, from the lateral frame members 12, 13 as illustrated in FIG. 5, and then the fixing plate 2 attached to one end of the screen 1 is demounted from the side frame member 11. Now that the screen 1 is not connected to the screen frame 10 by the wire and other means, except that the movable stile 15 is guided by the upper and lower lateral frame members 12, 13, the screen 1 can be demounted, together with the movable stile 15, from the lateral frame members 12, 13. Then, the screen fixing plate 3 is detached from the movable stile 15, so the screen assembly 20 including the screen 1, the fixing plates 2, 3 attached thereto, and the wire 5 incorporated therein can be demounted from the screen frame 10 and movable stile 15.

Figure 8:
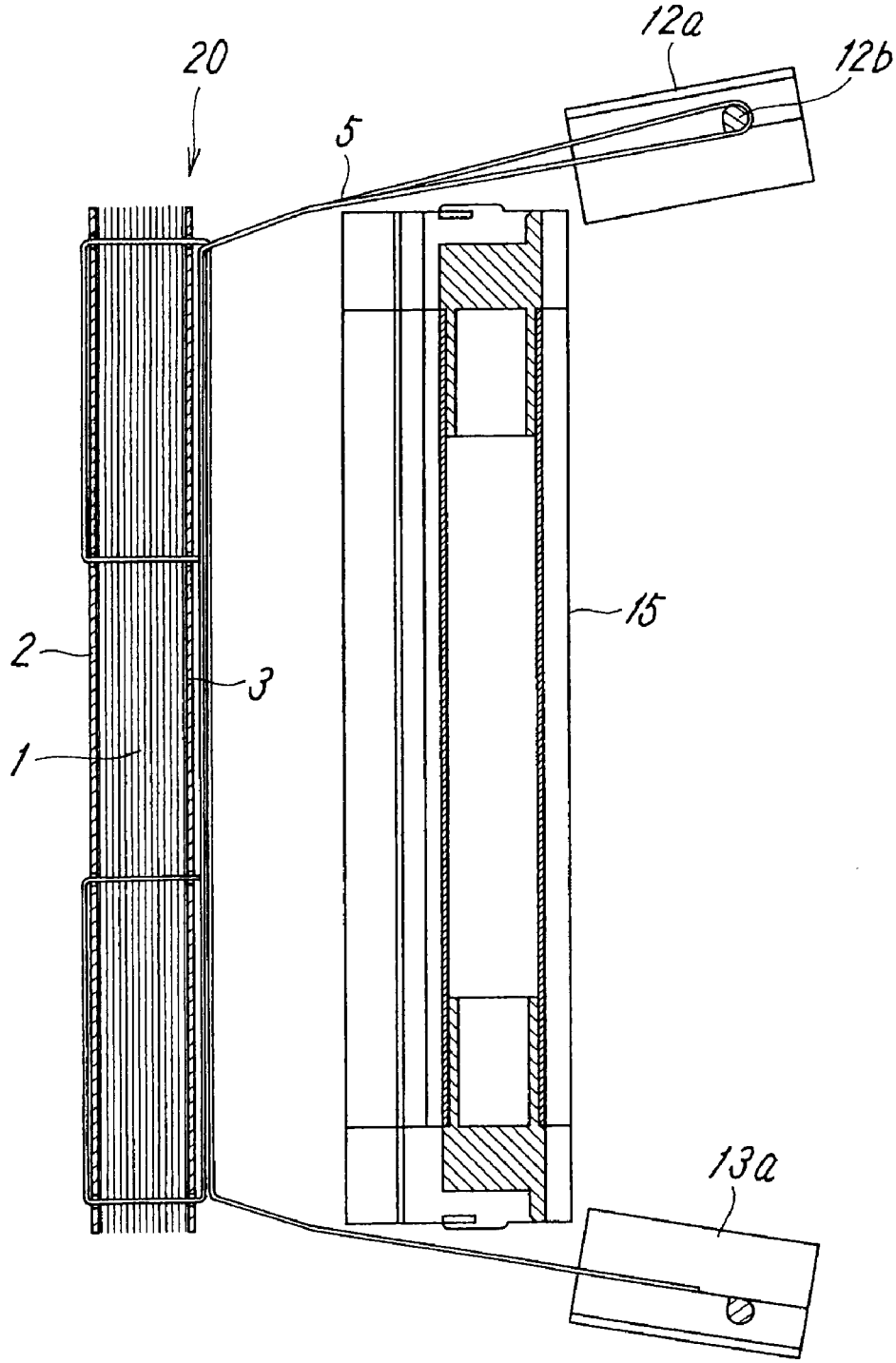
FIG. 8 is a front longitudinal sectional view of the demounted screen in the embodiment shown in FIG. 7.

Also in the embodiment shown in FIGS. 7 and 8, once both ends of the above wire 5 are disconnected, together with the connected pieces 12*a*, 13*a*, from the lateral frame members 12, 13, and the fixing plate 2 attached to one end of the screen 1 is demounted from the side frame member 11 as shown in FIG. 7, the screen 1 is not connected to the screen frame 10 by means of the wire 5 or other means, the screen 1 can be demounted, together with the movable stile 15 connected thereto, from the upper and lower lateral frame members 12, 13. Then, the screen fixing plate 3 is detached from the movable stile 15, so the screen assembly 20 can be demounted from the screen frame 10 and the movable stile 15 as shown in FIG. 8.

Other configurations and actions in the embodiment shown in FIGS. 7 and 8 are substantially no different from those of the embodiment described above with reference to the FIGS. 1 to 4, so they will not be referred to in the following description.

In both embodiments shown in FIGS. 1 and 7, the replacement of the screen 1 can be further facilitated if the connected pieces 12*a*, 13*a* separable from the lateral frame members 12, 13, respectively, have a length substantially identical to the total length of the movable stile 15 and screen assembly 20 with the screen 1 folded so that the screen assembly 20 and movable stile 15 can be introduced into and taken out of the screen frame 10 through the openings left after the connected pieces 12*a*, 13*a* are removed.

A replacement screen 1 is provided for the user in the form of the screen assembly 20, so the user can replace the screen assembly 20 simply by fastening both fixing plates 2, 3 of the new screen 1 to the movable stile 15 and the side frame member 11 of the screen frame 10 from which the screen assembly is removed in advance and then connecting to the lateral frame members 12, 13 the connected pieces 12*a*, 13*a* to which both ends of the wire 5 have been connected.

Figure 9:
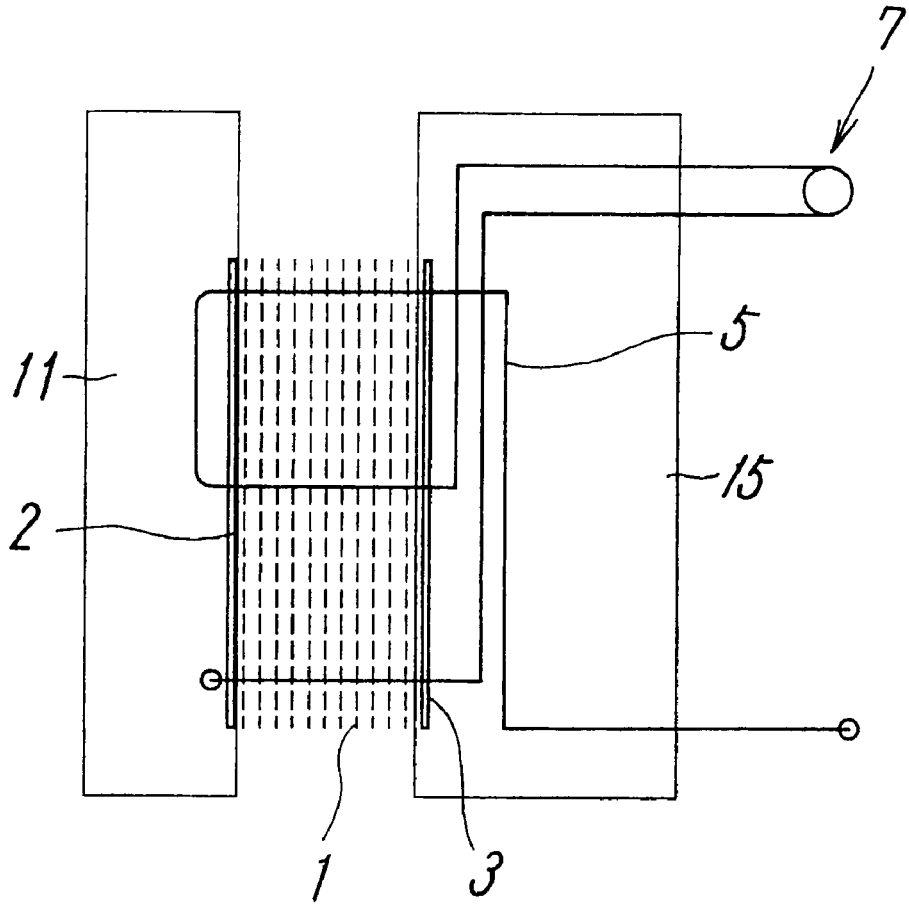
FIG. 9 schematically illustrates another wire arrangement of the translation mechanism according to the present invention.
Figure 10:
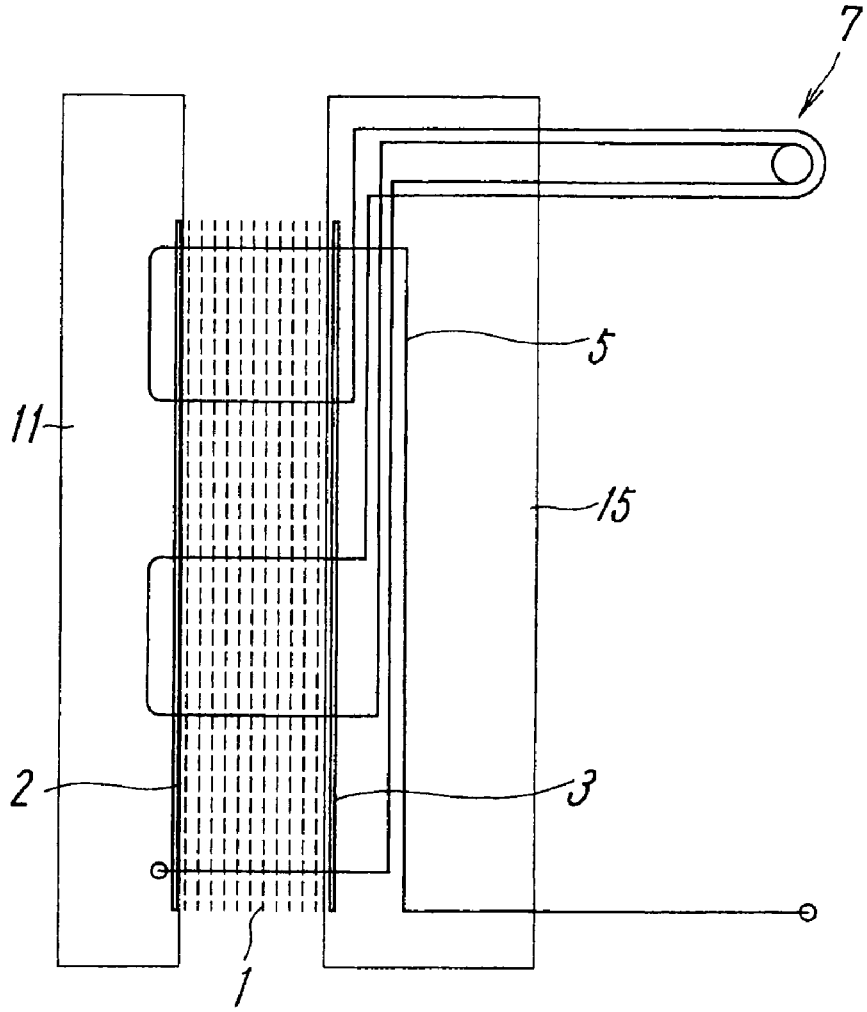
FIG. 10 schematically illustrates another wire arrangement of the translation mechanism according to the present invention.
Figure 11:
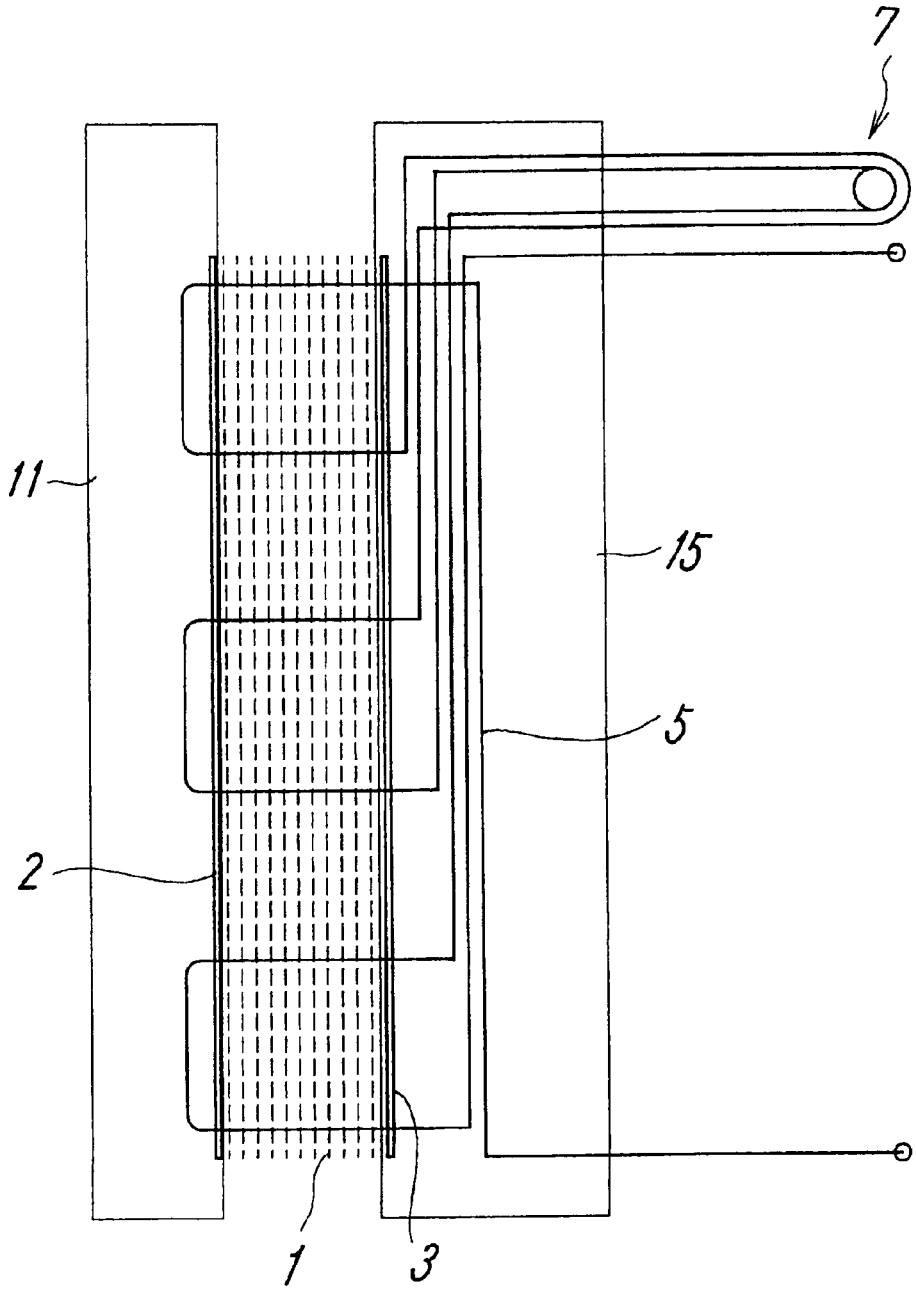
FIG. 11 schematically illustrates another wire arrangement of the translation mechanism according to the present invention.

FIGS. 9 to 11 schematically show other wiring arrangements for the translation mechanism of the present invention. The wire 5 is arranged in three rows through the screen 1 in FIG. 9, in five rows in FIG. 10, and in six rows in FIG. 11. When the wire 5 is arranged in an odd number of rows, one end of the wire 5 is fastened near the opposite frame member 14 and the other end to the fixing plate 2. When the wire 5 is arranged in an even number of rows, both ends of the wire 5 are fastened near the opposite frame member 14. In these embodiments, the wire 5 is fastened at one end thereof to or is redirected through the fixing plate 2 adjacent to the side frame member 11.

These embodiments have configurations substantially identical to that shown in FIG. 4 except that the wire 5 is arranged in a different number of rows, so they will not be referred to in the following description.

Figure 12:
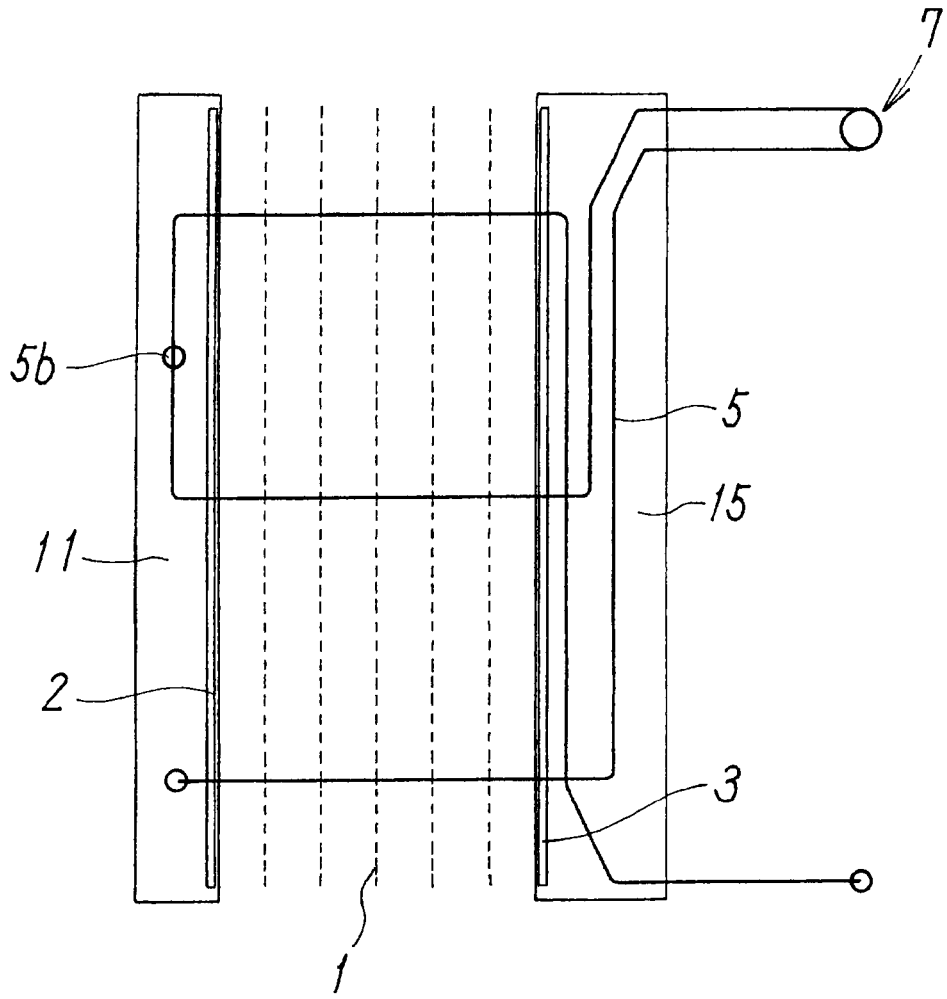
FIG. 12 schematically illustrates another wire arrangement of the translation mechanism according to the present invention.

FIGS. 12 to 15 schematically show other arrangements of the wire 5 for the translation mechanism of the present invention, in which the wire 5 is fastened at its intermediate fastening point or points 5*b* to the fixing plate 2. In FIG. 12, the wire 5 is arranged in three rows through the screen 1, while in FIGS. 13 to 15 the wire 5 is arranged in four rows through the screen 1.

Figure 13:
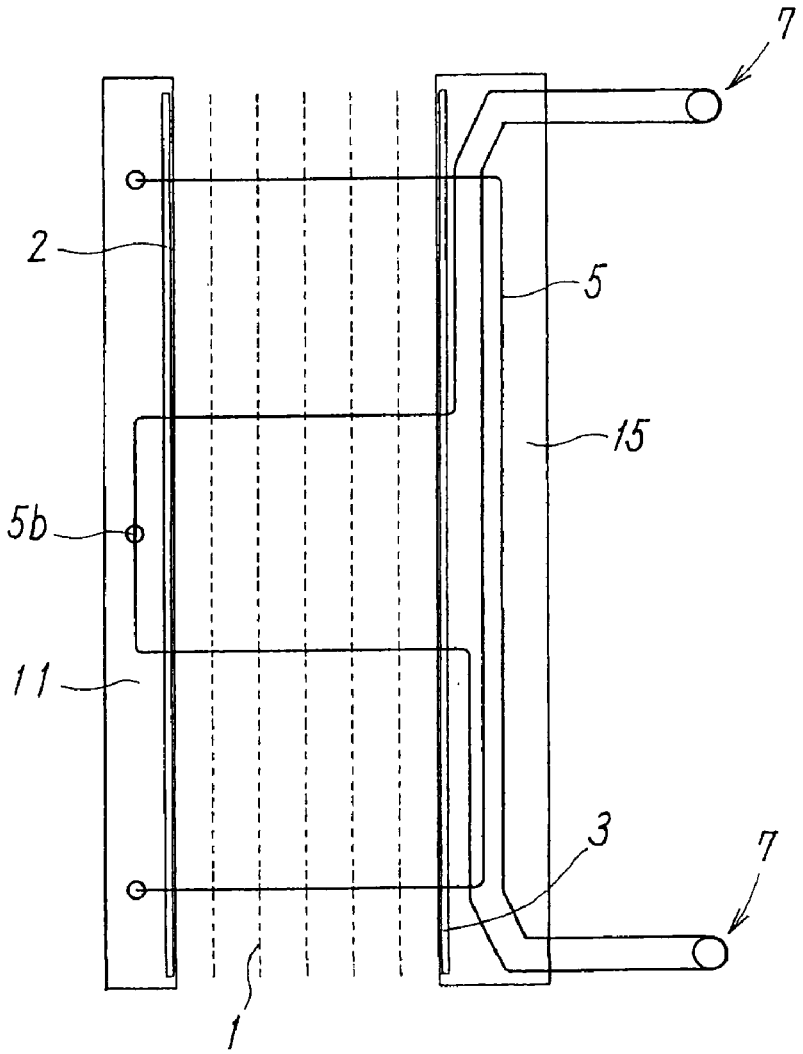
FIG. 13 schematically illustrates another wire arrangement of the translation mechanism of the present invention.
Figure 14:
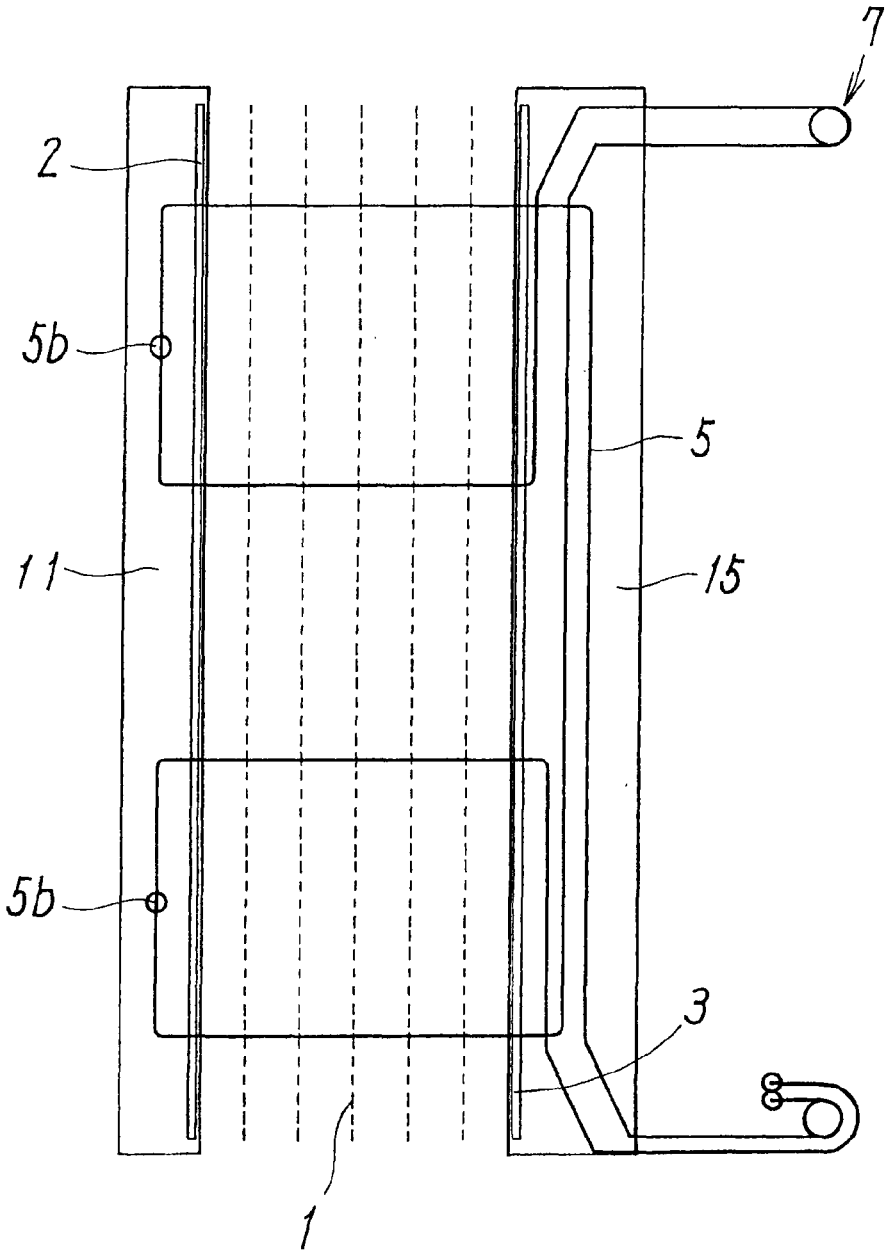
FIG. 14 schematically illustrates another wire arrangement of the translation mechanism according to the present invention.
Figure 15:
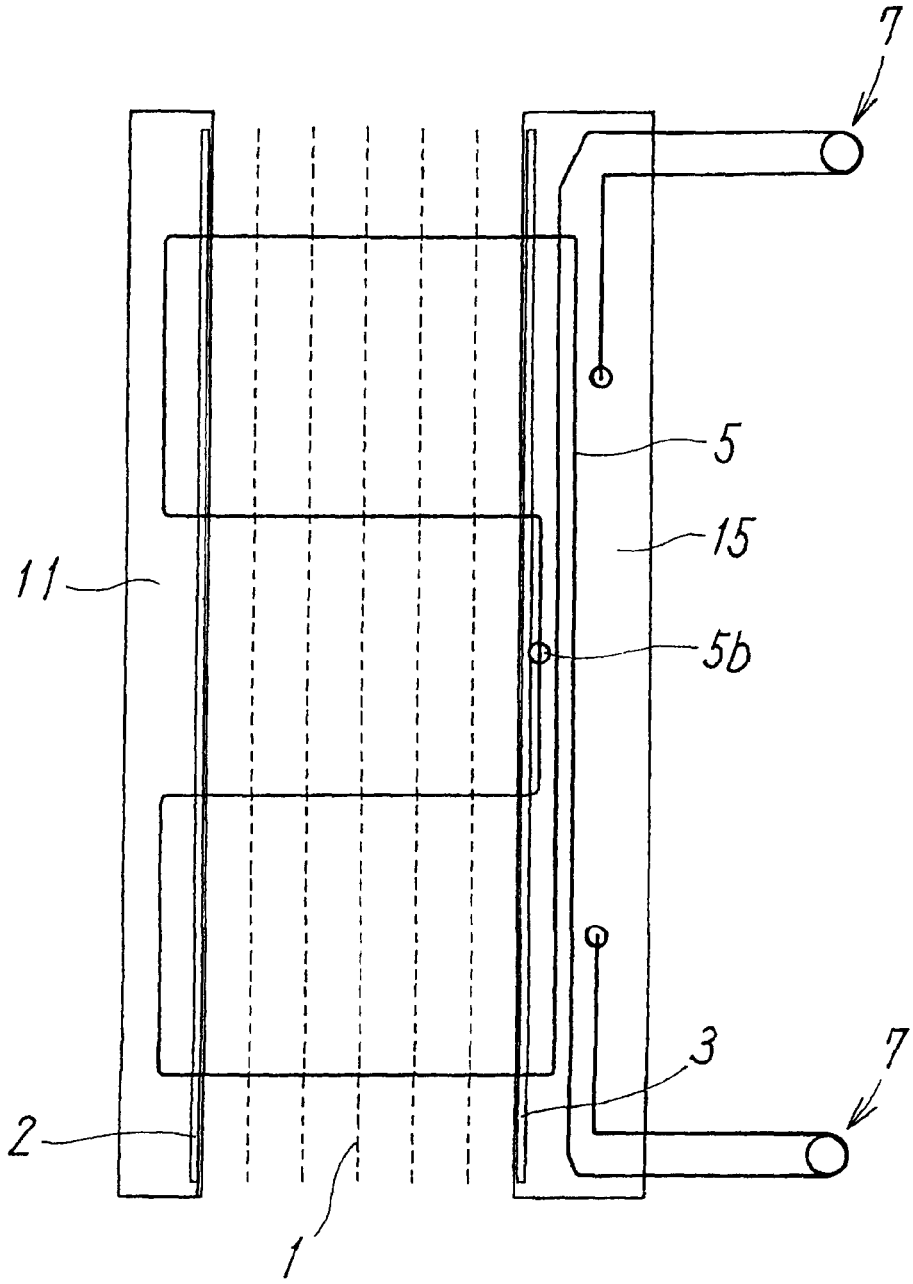
FIG. 15 schematically illustrates another wire arrangement of the translation mechanism according to the present invention.

More specifically, in FIG. 12, the wire 5 is fastened at one end thereof directly to the opposite wall side and connected at the other end thereof to the fixing plate 2 adjacent to the side frame member 11, while in FIG. 13, the wire 5 is turned back by the deflectors 7 provided in the upper and lower areas on the opposite wall side and fastened at both ends thereof to the fixing plate 2. In FIGS. 12 and 13, the wire 5 is fastened at its intermediate point to the fixing plate 2. In FIG. 14, the wire 5 is fastened at both ends thereof to the lower part of the opposite wall side, turned back by the deflector 7 in an upper area on the opposite wall side, and connected at two intermediate points thereof to the fixing plate 2 adjacent to the side frame member 11. In the embodiment shown in FIG. 15, the wire 5 is fastened at both ends thereof to the fixing plate 2 in the upper and lower areas, respectively, of the movable stile 15, is redirected by the deflectors 7 in the upper and lower areas on the opposite wall side, and is fastened at its middle point to the fixing plate 3 adjacent to the movable stile 15.

In the embodiments shown in FIGS. 12 to 15, in which the wire 5 is fastened at its intermediate fastening point or points 5*b* to the movable stile 15 or the fixing plate 2 adjacent to the side frame member 11, these intermediate point or points 5*b* should be a point or points that are not displaced relative to the side frame member 11 or movable stile 15 in its longitudinal direction. By fastening the intermediate point or points of the wire 5 in this manner, the influence of the elongation and shrinkage of the wire 5 on the translational movement of the movable stile 15 is minimized even if the wire 5 has some elasticity. The embodiments shown in FIGS. 12 to 15 are substantially the same as the above embodiment except that the intermediate point or points of the wire 5 are fastened, so they will not be referred to in the following description.

In the screen devices in the embodiments described above, the movement of the movable stile 15 causes the width of the screen 1 to vary and the length of the wire segments arranged in rows through the screen to vary accordingly, so the length of each segment of the wire 5 should be adjusted by means for absorbing changes in length of the wire segments, particularly when the wire 5 is arranged in multiple rows. For this adjustment, an adjustment means is configured in such a manner that the segments of the wire 5 that are arranged in rows extending through the screen 1, introduced into the movable stile 15, and guided upward or downward are all redirected in the upper and lower areas of the movable stile 15, and guided along the lateral frame members 12, 13 toward the opposite frame member 14 so that the wire 5 is stretched between the movable stile 14 and the opposite frame member 14 the same number of times as the number of rows extending between the side frame member 11 and the movable stile 15. The adjustment means is not limited to this configuration.

Since some of the wire segments arranged in rows through the screen, redirected at the inlet to the movable stile, and guided along the length of the movable stile 15 move at the same speed along the length of the movable stile 15 when the movable stile 15 moves, another adjustment configuration can be adopted in which some of the wire segments guided along the length of the movable stile 15 are redirected in the upper and lower areas of the movable stile 15, and guided along the lateral frame members 12, 13 of the screen frame 10 toward the opposite frame member 14, while the remaining wire segments moving at the same speed are connected to those wire segments redirected in the upper and lower areas of the movable stile so that the wire segments along the lateral frame members 12, 13 can absorb changes in the length of the wire segments extending through the screen in accordance with the movement of the movable stile 15.

The invention claimed is:

1. A screen device comprising:

a screen frame including a side frame member and upper and lower lateral frame members;

a movable stile guided along the upper and lower lateral frame members of the screen frame for opening and closing operations, the movable stile detachably mounted to the upper and lower lateral frame members of the screen frame;

a screen having a first end and a second end in a lateral direction, the screen connected at the first end to the side frame member, the screen connected at the second end to the movable stile, and the screen contractible and expandable by folding so as to be openable and closable, respectively;

a translation mechanism for translationally moving the movable stile with respect to the side frame member by constraining by one contiguous wire an attitude of the movable stile regardless of a position to which the movable stile is moved;

a first mounting groove in the side frame member, the first mounting groove having an opening which faces the screen;

a first fixing plate mounted to the first mounting groove so as to be detachable through the opening facing the screen, the first fixing plate:

fixed to the first end of the screen, having a first front surface facing the screen and a first rear surface opposed to the first front surface, and including a plurality of first guide holes penetrating through the first front surface and the first rear surface, the first guide holes provided to insert the one wire therethrough, wherein the translation mechanism is configured such that:

the one wire has segments arranged in three or more rows extending through the screen in an expansion/contraction direction of the screen, individual end portions of the wire segments extended through rows of the screen of the one wire, on a side of the movable stile, are redirected in upper and lower directions of the movable stile at inlets of the movable stile, wire segments guided in upper and lower directions in the movable stile as a result of redirection in the movable stile are all redirected in upper and lower end portions of the movable stile in the lateral direction and guided along the upper and lower lateral frame members toward an opposite frame member that faces the movable stile so that the total number of wire segments stretched between the movable stile and a side of the opposite frame member along the upper and lower lateral frame members is the same as the total number of wire segments extended through the rows of the screen, the wire segments stretched between the movable stile and the side of the opposite frame member along the upper and lower lateral frame members constitute an adjustment portion that absorbs changes in length of the wire segments extending through the screen in accordance with movement of the movable stile, the adjustment portion is configured such that at least a pair of wire segments of the wire segments stretched between the movable stile and the side of the opposite frame member along the upper and lower lateral frame members are contiguous with each other by being folded back at the side of the opposite frame member by being wound around a deflector that is provided in the opposite frame member or the lateral frame member, and individual end portions of wire segments extended through rows of the screen of the one wire, on a side of the side frame member, are all, without being penetrated through the side frame member, either (1) fixed to the first fixing plate or (2) inserted through the first guide holes of the first fixing plate from the first front surface to the first rear surface, redirected upward or downward on a side of the first rear surface by the first guide holes, wholly guided linearly along the first rear surface in the first mounting groove, subsequently inserted from the first rear surface into the first guide holes to be guided to the first front surface, and then are contiguous with wire segments of other rows extended through the screen.

2. The screen device according to claim 1, wherein the wire is connected only at both ends thereof to the side frame member, the opposite frame member, the lateral frame members near the side or opposite frame member, to the movable stile or the first fixing plate.

3. The screen device according to claim 1, wherein the one wire is connected at an end and a wire segment passing on the first rear surface of the first fixing plate to the first fixing plate, the wire segment being a point that is not displaced relative to the side frame member in a longitudinal direction thereof when performing the opening or closing operation.

4. The screen device according to claim 1, wherein the adjustment portion is configured such that all wire segments stretched along the upper and lower lateral frame members between the movable stile and the side of the opposite frame member are folded back by being wound around the deflector.

5. The screen device according to claim 4, wherein both ends of the one wire constituting the translation mechanism are fixed to the first fixing plate.

6. The screen device according to claim 1, wherein the adjustment means is configured in such a manner that some of the wire segments that are arranged in multiple rows extending through the screen, then redirected at the inlet to the movable stile, and guided along the length of the movable stile are redirected in the upper and lower areas of the movable stile and guided along the lateral frames of the screen frame toward the opposite frame member facing the movable stile, while the remaining wire segments are connected to the some of the wire segments, so that the wire segments along the lateral frames can absorb the changes in length of the wire segments extending through the screen in accordance with the movement of the movable stile.

7. The screen device according to claim 1, wherein one end of the screen is detachably fastened to the side frame member of the screen frame with the fixing plate attached to that end of the screen therebetween;

wherein the screen and the movable stile are detachably guided along the lateral frame members of the screen frame;

wherein the wire segments extending through the screen toward the side frame member are fastened to or redirected through the fixing plate, without extending through the side frame member;

wherein both ends of the wire are detachably connected;

wherein the wire segments that are not fastened on the opposite frame member side are wound around the deflector that is detachably mounted thereon.

8. The screen device according to claim 1, wherein one end of the screen facing the movable stile is detachably fastened to the movable stile with the fixing plate attached to that end of the screen therebetween;

wherein the wire segments extending through the screen to the side frame member or movable stile are fastened to or turned back and redirected through the respective fixing plates, without extending through the side frame member or the movable stile;

wherein both ends of the wire are detachably connected;

wherein the wire segments that are not fastened on the opposite frame member side are wound around the deflector detachably mounted thereon.

9. The screen device according to claim 1, further comprising:

a second mounting groove in the movable stile, the second mounting groove having an opening which faces the screen; and a second fixing plate detachably mounted to the second mounting groove through the opening facing the screen of the second mounting groove, the second fixing plate:

fixed to the second end of the screen, having a second front surface facing the screen and a second rear surface opposed to the second front surface, and including a plurality of second guide holes penetrating through the second front surface and the second rear surface, the second guide holes provided to insert the one wire therethrough, wherein the translation mechanism is configured such that individual end portions of the wire segments extended through the rows of the screen of the one wire, on the side of the movable stile, are all inserted through the second guide holes of the second fixing plate from the second front surface to the second rear surface, redirected upward or downward on a side of the second rear surface by the second guide holes, and wholly guided linearly in the upper and lower direction along the second rear surface in the second mounting groove.

10. The screen device according to claim 9, wherein the one wire constituting the translation mechanism is connected at an end and a wire segment passing on the first rear surface of the first fixing plate to the first fixing plate, the wire segment being a point that is not displaced relative to the side frame member in a longitudinal direction thereof when performing the opening or closing operation.

11. The screen device according to claim 9, wherein the adjustment portion is configured such that individual wire segments stretched along the upper and lower lateral frame members between the movable stile and the side of the opposite frame member all turned back by being wound around the deflector.

12. The screen device according to claim 11, wherein both ends of the one wire constituting the translation mechanism are fixed to the first fixing plate.

13. The screen device according to claim 9, wherein the movable stile is configured such that the second mounting groove is opening in an axial direction at the upper and lower ends of the movable stile; and the wire segments guided in the second mounting groove along the second rear surface in the upper and lower direction are all, without being penetrated through the movable stile, drawn out of openings in the upper and lower ends of the movable stile and redirected in the lateral direction, to thereby be guided along the upper and lower lateral frame members to the side of the opposite frame member facing the movable stile.

14. The screen device according to claim 1, wherein the deflector has a pivot extending in the axial direction of the lateral frame member, the deflector being mounted to the opposite frame member or the lateral frame member so as to be rotatable about the pivot.

15. The screen device according to claim 9, wherein the deflector has a pivot extending in the axial direction of the lateral frame member, the deflector being mounted to the opposite frame member or the lateral frame member so as to be rotatable about the pivot.

* * * * *